United States Patent [19]
Moore
[11] 4,270,329
[45] Jun. 2, 1981

[54] INSULATED WALL AND WALL PART

[76] Inventor: Alvin E. Moore, 8712 Manini Way, Diamondhead, Bay St. Louis, Miss. 39520

[21] Appl. No.: 33,723

[22] Filed: Apr. 26, 1979

[51] Int. Cl.[3] ..... E04C 1/06
[52] U.S. Cl. ..... 52/576; 52/309.12; 52/DIG. 9
[58] Field of Search ..... 52/576, 601, DIG. 9, 52/309.12

[56] References Cited

U.S. PATENT DOCUMENTS

| | | | |
|---|---|---|---|
| 1,420,220 | 6/1922 | Roux | 52/DIG. 9 |
| 4,068,429 | 1/1978 | Moore | 52/293 |

*Primary Examiner*—John E. Murtagh
*Attorney, Agent, or Firm*—Alvin E. Moore

[57] ABSTRACT

An inexpensive, insulated, upright wall, ceiling, floor or roof, made of panels fastened together at panel edges. Each panel has a can backing and supporting element (preferably masonite, but alternatively plywood, plastic, metal lath or the like), panel-reinforcing bars connected to edges of the can-backing element, a plurality of layers of randomly-placed cans on the can-backing element and within the bars, and a can supporting and stabilizing element on the side of the cans opposite to the can-backing element. Saving labor of more careful arrangement of the cans, and increasing the strength against breaking of the panel, they are heterogeneously dumped into the frame of the bars and the can-backing element; and preferably the frame is shaken to somewhat settle the cans in it. In further stabilization of the cans in place, preferably porous, insulating concrete material, or foamed concrete, or foamed polyolefin plastic material is placed on top of the assembled cans. The outer can-supporting element may be unitary—a panel surface formed of this concrete or foam-plastic material—but preferably it is composite and includes this material and other panel-surfacing material, such as a sheet of masonite, plywood or celotex, applied while the concrete or foam plastic is in pasty or fluent condition, adhering to the concrete or foam plastic. Optionally the cans may be glass bottles or jars, but preferably they are used cans of the beer or soft-drink type. Optionally: the concrete or foam-plastic material may be metal-reinforced; the side bars may be of wood; the frame, into which the cans are dumped, may be a box of molded plastic; or the cans may be dumped within a can holder, temporarily positioned within the outer frame, this holder being withdrawn after the concrete or foam-plastic material is poured on top of and within spaces provided by the filler, the sides of the assembled cans, thus forming a plastic-material outer can-supporting element and associated side bars. The wall may include exterior masonry units, siding, or stucco.

4 Claims, 6 Drawing Figures

FIG. 1
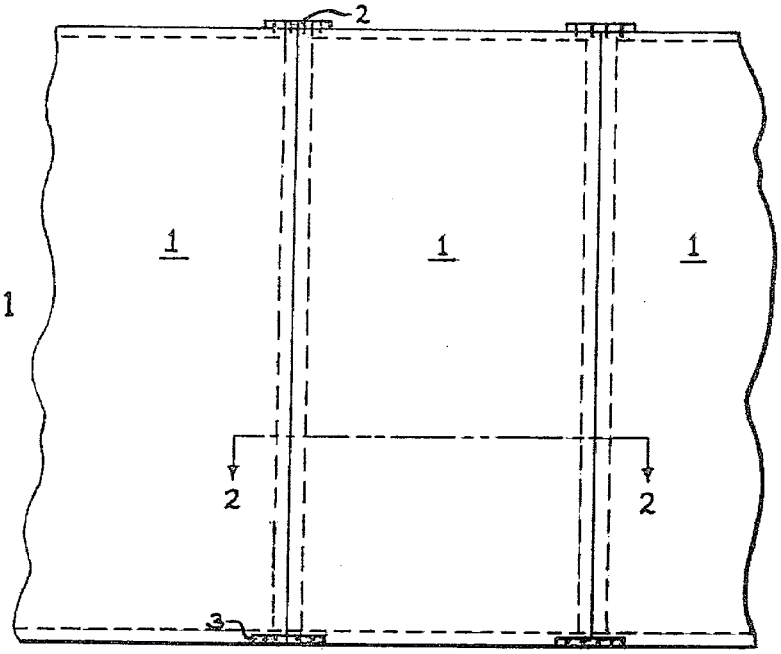
FIG. 2
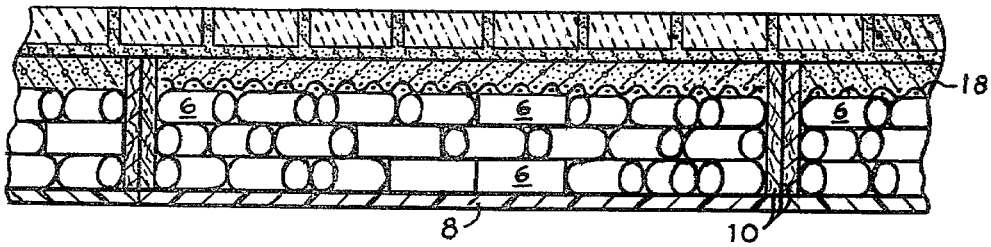
FIG. 3
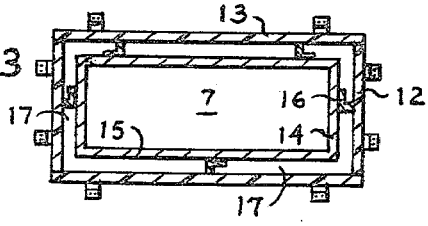
FIG. 4
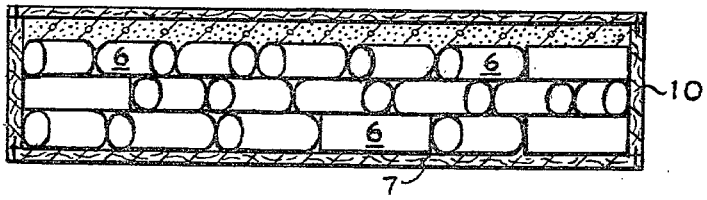
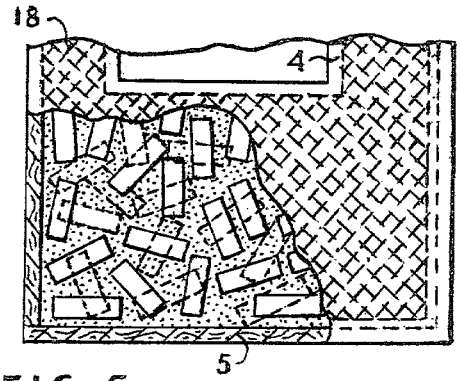
FIG. 5
FIG. 6
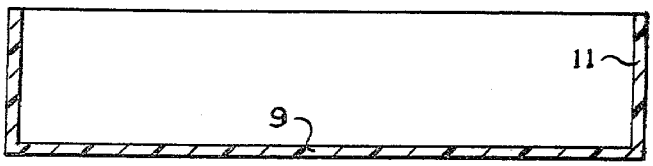

INSULATED WALL AND WALL PART

The present invention comprises an improvement of this inventor's prior invention in Patent Application Ser. No. 863,126, filed on Dec. 22, 1977 now U.S. Pat. No. 4,158,275.

Some of the objects of the present invention are to provide: (1) a thoroughly insulated, inexpensive upright wall, ceiling or the like, utilizing a plurality of layers of randomly-arranged cans, between the exterior and interior of the wall; (2) such a wall comprising panels that are fastened together at panel edges; (3) a wall as in (2) above, in which at least some of the panels have door or window frames; (4) a wall part including randomly stacked cans in a closed box having inner and outer can-supporting elements, with at least two—and preferably three or four—randomly arranged tiers of cans between these inner and outer elements; (5) a wall panel as in (4) above, in which insulating, porous concrete or foamed plastic-material, stabilizing the randomly arranged cans, forms a facing element of the panel; (6) a wall panel as in (4) above, containing a wall-opening frame for a window or door, which has sufficient width to support adjacent, randomly-stacked cans; (7) a wall comprising a plurality of panels of the above type and exterior wall-finishing material which includes masonry units, siding or stucco. These and other objects of the invention are indicated in the following specification and the attached drawings.

In these drawings: FIG. 1 is an elevational view of an upright wall (or this FIGURE may be considered to be a plan view of a floor, ceiling or roof;

FIG. 2 is a cross-sectional view of the wall from a plane indicated by the line 2—2;

FIG. 3 is a horizontal sectional view, on a reduced scale, across a mold, including a temporarily-positioned can-holding filler within the mold.

FIG. 4 is a sectional view, similar to FIG. 2, of an optional form of the wall panel;

FIG. 5 is a vertical elevational view, partly broken away, and partly in section, of an optional form of the upright-wall panel, containing a window or door frame, optionally including metal reinforcement of the concrete or foamed plastic material; and FIG. 6 is a cross-sectional view of an optional, integral, plastic can-holding frame.

The present invention is of a paneled, can-comprising wall (an upright wall, ceiling, floor or roof), usable in a building anchored to land, a mobile home, motor home or trailer, a land vehicle, boat, or the like, and includes a panel that has randomly arranged cans providing an insulating panel thickness of two or more tiers of the cans. As illustrated in FIG. 1, the wall may be formed of panels 1 (for example, sixteen inches, two feet or four feet wide, by eight feet high) which may be joined along vertical lines and fastened together by metallic or plastic tie plates 2 and nails, screw or glue. Optionally the panels also are fastened together by tie plates 3 at their bottoms and/or glue along their junctions. Some of the panels (more than four feet wide) may contain a window frame 4, or a similar door frame, with the bottom of its opening being located at the upper surface of the lower side 5 of the panel. Optionally, the junction lines of the panels may be horizontal, and the panels then are preferably six or eight feet long in a horizontal direction and sixteen inches, two feet or four feet high.

As illustrated in FIG. 2 to 4, each panel includes a frame into which the cans 6 are heterogeneously dumped. These cans optionally may be glass bottles or jars, or used or new paint cans, or plastic containers; but preferably they are used metallic or plastic cans of the type that has contained beer or soft drinks. The cans are randomly dumped into the frame in sufficient number to fill most of it but not come all the way up to its top, after the frame is shaken a bit (manually or by machinery) to somewhat settle and stabilize them. They fall haphazardly with their axes at various angles to each other—making many acute and obtuse angles between axes; but some of the cans fall into parallelism. The intersecting axes and staggered relationships provide extra strength to the can-containing panel.

Each can-holding frame comprises: a can-backing element, which optionally may be a sheet of masonite or plywood, 7, a sheet of plastic or celotex, 8, or an integral panel-facing plastic element 9 of a molded-plastic can-holding frame; and frame sides, which optionally may be separate bars 10, of lumber or masonite, or integral bars 11, which are parts of the molded-plastic frame of FIG. 6.

After the cans are dumped into the frame, and the frame is shaken for settling of the cans, porous insulating material capable of setting from fluent or plastic condition is poured on top of the cans. This insulating material may comprise mortar cement (comprising portland cement and line) mixed with porous, insulating aggregate such as porous, expanded baked clay or shale, cinders, vermiculite, shredded or ground foamed plastic; or the insulating material may be foamed concrete or foamed polyolefin plastic–for example, polyurethane foam. When this material is porous concrete material in pasty form it is not necessary to close any of the holes of opened used beer or soft-drink cans; but when mixed foam-plastic liquids are utilized, preferably at least the openings of the upper cans in the frame are closed with bits of adhesive tape—or else the opened can ends of the upper cans are turned downward.

Before the porous concrete material sets it may be leveled off with a metal bar. Or, alternatively and preferably, the frame is further covered by placing over the concrete or foam plastic a sheet 12 of masonite, plywood or the like, which is clamped tightly against the upper edges of the frame sides, forcing surplus concrete or foam plastic into the mass of cans until its upper surface is substantially level. This clamping operation may be effected by the use of a manually or power actuated jig.

FIG. 3 illustrates an optional means for forming all four sides and a top element of the box of concrete or foam plastic. The mold, which may be of plastic or teflon-coated masonite or plywood, comprises hinged sides 12 and 13, within which the can-backing sheet 7 is placed, at the bottom of the mold. Then the can-holding filler element is placed. This filler element has an open bottom, joined side walls 14 and 15 of metal, and angle irons or brackets 16 which keep the filler walls properly spaced from the mold walls. The filler has upper looped handles (not shown) for placing it and withdrawing it from the mold, and the mold walls have hooks or other fastening means for temporarily holding the walls in position for pouring the concrete or foam-plastic liquids. After the cans are dumped into the filler and the hold is shaken, the concrete or foam-plastic liquids are poured into the spaces 17. Then before the plastic material sets the filler is withdrawn from the mold. The concrete or foam plastic thus sheathes the sides and top of the randomly placed cans. When concrete material is utilized in this form of the invention it is wet and fluent enough to go to the bottom of the spaces 17.

FIGS. 3 and 5 illustrate an additional element which optionally may be utilized in any of the forms of the invention: the network 18 which optionally reinforces the porous plastic material. This network may be of the inexpensive poultry-fence type; but preferably it is a piece of metal lath of a size which fits within edge portions of the sides 10. It rests on the randomly assembled cans before the concrete material or mixture of foam-plastic liquids is placed on the cans and network. Optionally, instead of network, the metallic reinforcement may comprise metal rods, preferably of small diameter.

Within the spirit of the invention various changes may be made. For example, the panels may be elongated and narrow (for instance, 8″×10″ in cross section), and then may be horizontally laid in mortar between adjacent horizontal panel faces.

In the claims, unless otherwise qualififed: "can" signifies a hollow container, open or sealed, of metal, plastic, glass or other material; "wall" means an upright wall or a roof, ceiling or floor; "bar" signifies a long piece of wood, masonite, metal, concrete, or other appropriate material; and "porous plastic material" signifies foamed plastic, foamed concrete, or a mixture of calcareous cement and porous concrete aggregate.

I claim:

1. A transportable wall panel, including:

a can-supporting element;

at least two bars, positioned at opposite edge portions of said can-supporting element, at angles with respect to said element;

a first tier of cans on said can-supporting element, between said bars;

a second tier of cans, superposed on said first tier;

at least one other tier of can superposed on said second tier;

the top tier of cans being spaced downward and inward from the top edges of said bars;

insulating material on said top tier, between said bars, in the space between the top cans and said top edges of said bars; and a substantially planar, panel-reinforcing element over said insulating material, and connected to upper edge portions of said bars.

2. A wall panel as set forth in claim 1, in which said insulating material is porous plastic material and said substantially planar element is of fibrous material.

3. A wall element as set forth in claim 1, including metal network, reinforcing said panel and insulating material.

4. A wall panel as set forth in claim 1, in which the cans of said tiers are randomly arranged.

* * * * *